United States Patent [19]

Goans

[11] 4,422,503

[45] Dec. 27, 1983

[54] CONTROL LINE BLOW OUT PREVENTER

[75] Inventor: Kip B. Goans, Harvey, La.

[73] Assignee: Baker Cac, Inc., Belle Chasse, La.

[21] Appl. No.: 318,290

[22] Filed: Nov. 4, 1981

[51] Int. Cl.[3] ..... E21B 33/06

[52] U.S. Cl. ..... 166/53; 166/64; 166/97; 137/73; 137/74; 137/75; 137/496; 137/553; 91/394

[58] Field of Search ..... 166/53, 64, 97; 137/73, 137/74, 75, 457, 496, 498, 553, 613; 91/394

[56] References Cited

U.S. PATENT DOCUMENTS

| | | | |
|---|---|---|---|
| 2,774,366 | 12/1956 | Dado | 137/75 |
| 2,940,470 | 6/1960 | Morgan | 137/496 |
| 3,238,850 | 3/1966 | Desmarchelier | 91/394 |
| 3,289,686 | 12/1966 | Tyer, Jr. | 137/74 |
| 4,202,368 | 5/1980 | Akkerman et al. | 137/498 |
| 4,270,849 | 6/1981 | Kalbfleisch | 137/75 |
| 4,290,440 | 9/1981 | Sturgis | 137/75 |
| 4,364,407 | 12/1982 | Hilliard | 166/325 |

*Primary Examiner*—Ernest R. Purser
*Assistant Examiner*—William P. Neuder
*Attorney, Agent, or Firm*—Norvell & Associates

[57] ABSTRACT

An improved control line blow out preventer valve is provided, having a fluid pressure chamber interposed in a control line extending from a surface control panel to a downhole safety valve in a subterranean well. Axially spaced inlet and outlet openings are provided in the pressure chamber and a piston is reciprocally mounted intermediate the inlet and outlet openings. A sealing plug carried by the piston cooperates with a seal surrounding the inlet opening. A bypass passage through the piston mounts a check valve which permits free fluid flow in the direction from the control panel to the subsurface safety valve but only a restricted fluid flow in the opposite direction. A check valve is mounted in the outlet passage to prevent fluid flow from the subsurface safety valve to the control panel. A fusible link normally maintains this check valve off its seat so that it does not close until the occurrence of an elevated temperature caused by fire. At the inlet port a bleed valve which is thermally activated is incorporated in order to bleed off the safety valve, or other apparatus, pressure in the event of a fire.

3 Claims, 2 Drawing Figures

CONTROL LINE BLOW OUT PREVENTER

BACKGROUND OF THE INVENTION

1. Field of the Invention:

The invention relates to a blow out preventer which may be utilized within a hydraulic circuitry extending from a surface control panel to a safety valve located within a subterranean well.

2. Description of the Prior Art:

In order to isolate a subterranean oil or gas well during a blow out, fire or other catastrophy, safety valves are installed in the well, which may be manipulated between open and closed positions by variation of hydraulic pressure contained within a line extending from the safety valve to a control panel at the surface of the well. Typically, such control systems have utilized an hydraulic-pneumatic interface valve which is sensitive to variance within a pneumatic signal source which depicts abnormal well conditions, such that the pneumatic signal will activate the interface valve to send hydraulic pressure to the downhole safety valve and maintain the safety valve in an open position until an adverse well condition causes sufficient variation within the pneumatic signal source to, in turn, cause the interface valve to shift and vary the hydraulic pressure signal to the safety valve to manipulate it to a closed position. As the hydraulic-pneumatic interface valve is activated, the interface assembly shifts to block hydraulic supply and concurrently bleeds pressure out of the control line extending to the downhole safety valve. However, such assemblies having a hydraulic-pneumatic valve within the control panel permit a continuous communication of fluid within the control line to the reservoir after the shut-in signal has been activated, because the dump port within the hydraulic-pneumatic interface valve is opened and remains opened, even though the downhole safety valve has been manipulated to the closed position. In the event of a packing or conduit failure immediate the safety valve assembly, the open port within the hydraulic-pneumatic interface valve assembly will permit well and control fluids to flow up through the control line and into the control unit. There is often a potential fire hazard and the environmental pollution possibility is readily apparent.

It has been previously proposed, for example in U.S. Pat. No. 4,202,368 to Akkerman et al., to provide a blow out preventer wherein the closing manipulation of the safety valve does not interfere with utilization of the control line blow out preventer disclosed in such patent. Such patent provides a blow out preventer that permits repeated operation of the safety valve between open and closed positions. Only when flow returns at excessive flow rates are encountered within the blow out preventer described in the aforementioned patent during an abnormal closing of the safety valve, or during emergency shut down of the well, does the previously patented blow out preventer effect the isolation of the control line from the blow out preventer to the safety valve from the hydraulic circuitry extending to the control panel.

Utilization of the blow out preventer device disclosed in the aforementioned Akkerman et al. patent has revealed that under cetain unique conditions, the blow out preventer may not reliably effect the closing of the ball valve which shuts off communication between the downhole safety valve and the blow out preventer. The unique conditions that would cause this undesired operation is the presence of gas in the control line extending from the blow out preventer to the downhole safety valve. When the control panel is operated to remove fluid pressure from the control line extending to the safety valve through the blow out preventer mechanism, any trapped gas contained in the line intermediate the blow out preventer and the downhole safety valve will effect a very rapid shifting of the piston contained in the blow out preventer to its upper position due to the fact that there is little, if any, pressure opposing the rise of the piston, and the trapped gas is applied to the underside of the piston and effects its rapid movement to the uppermost position. In such uppermost position, the actuating stem for the ball valve, which permits the closing of such valve when the piston reaches its upper position, is free to retract, but, because of the trapping of gas pressure below the piston, such pressure opposes the closing of the ball valve and hence it may remain open for a significant period, thus, defeating the purpose of the blow out preventer.

Additionally, there is need for a temperature sensitive actuation of the ball valve that is normally positioned between the blow out preventer and the conduit extending to the downhole safety valve. A blow out or fire may occur near the well head and its presence may not be reported by other instrumentation to the control panel to trigger the operation of the control panel to close the downhole safety valve. There is a need for a mechanism for effecting the closing of such ball valve in response to abnormal temperature conditions, even prior to the shifting of the main piston of the blow out preventer to its upper or flow disconnecting position.

SUMMARY OF THE INVENTION

This invention provides a modified construction of the blow out preventer disclosed in U.S. Pat. No. 4,202,368 to Akkerman et al. which insures the closing of the ball valve in the conduit extending from the blow out preventer to the downhole safety valve even in the presence of gas in such conduit.

The actuating stem for holding the ball valve in the flow conduit in an open position is now formed from a piece of eutetic wire, and the housing for such valve is extended outwardly from the housing of the control valve preventer to provide greater exposure of the eutetic wire to the surrounding temperature. Additionally, to eliminate the trapped gas problem described above, a sealing plug is provided on the upper surface of the main piston of the blow out preventer mechanism which cooperates with a seal provided in surrounding relationship to the inlet conduit which extends to the surface control panel.

Lastly, a temperature responsive "block-and-bleed" valve of conventional configuration is interconnected between the inlet part of the blow out preventer and the conduit leading to the surface control panel. Thus, in the normal operation of the blow out preventer mechanism, when abnormally high temperatures are not present, the closing of the conduit from the safety valve to the control valve is accomplished in the blow out preventer by the cooperation of the sealing plug on the top of the blow out preventer piston with the seal previously mentioned. In the event of abnormal temperature conditions, the conduit is effectively closed at two points. First, the operation of the temperature responsive "block-and-bleed" valve at the upper part of the blow out preventer mechanism will prevent the transmission of control pressure from the surface to the interior of the blow out preventer mechanism and concurrently bleed the control pressure. Secondly, the melting of the fusible link holding the ball valve off its seat at an even higher temperature will effect a closing of the conduit between the downhole safety valve and the blow out preventer mechanism. Thus, under both abnormal types of operation, involving either trapped gas or high immediate temperatures, the operation of the control valve blow out preventer to close the conduit between the downhole safety valve and the control panel is reliably accomplished.

DESCRIPTION OF THE PREFERRED EMBODIMENT

Figure 1:
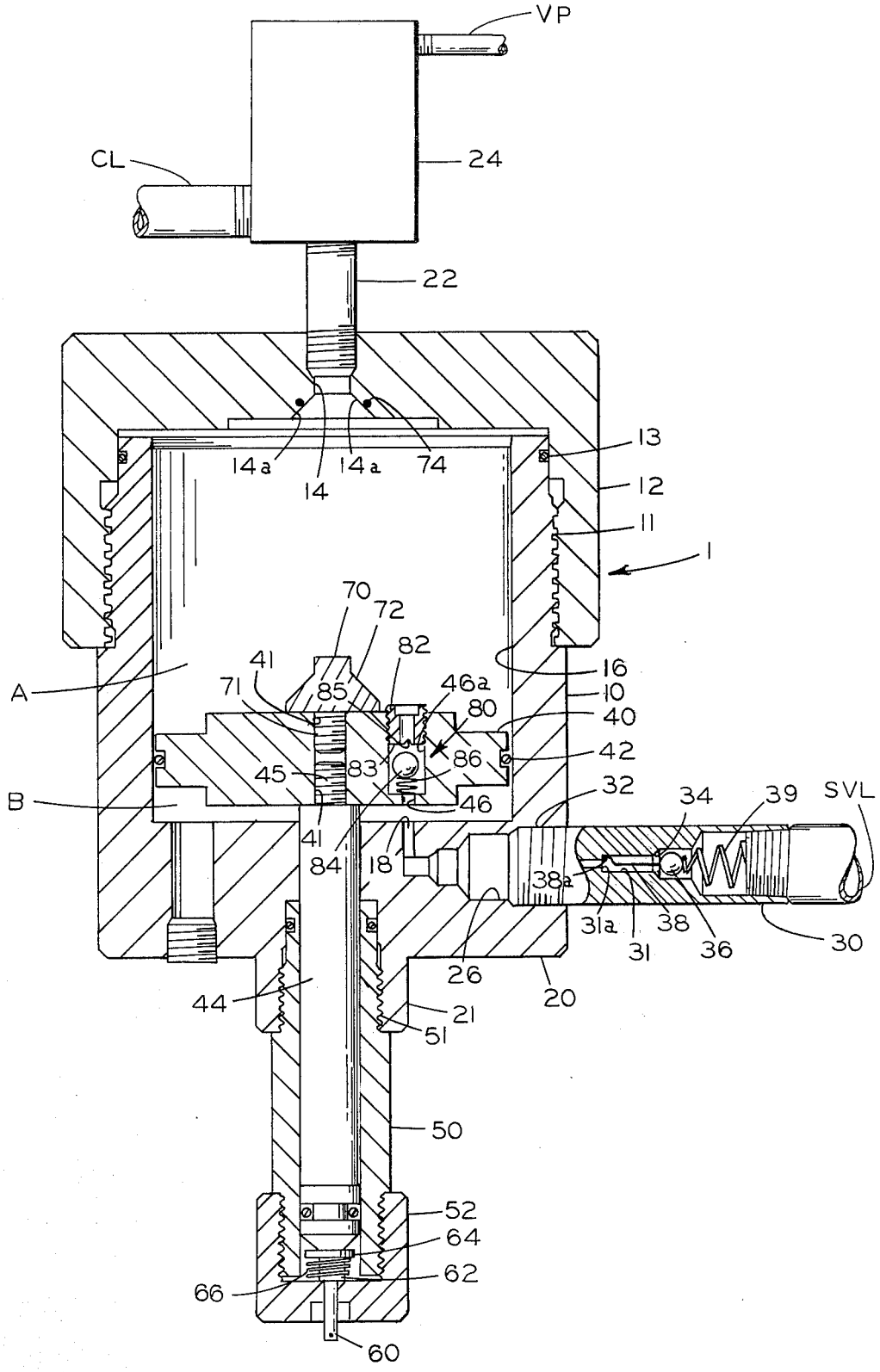
FIG. 1 is a vertical sectional view of a blow out preventer incorporating this invention shown in an interposed relation to a control line extending from the surface to a downhole safety valve, with the elements of the blow out preventer shown in its open or pressure transmitting position, to the down hole valve.

Referring to FIG. 1, a blow out preventer 1 embodying this invention comprises a hollow cylindrical cup-shaped housing 10 which is closed by a cap 12 threadably secured thereto by threads 11. A seal 13 prevents fluid leakage through the threads 11 and thus a fluid pressure chamber 16 is defined by the inner wall surfaces of the housing 10. An inlet opening 14 is provided in cap 12 at one end of the pressure chamber 16. A fluid outlet 18 is provided in the bottom wall portion 20 of the housing 10.

Fluid inlet 14 is connected by a pipe 22 to a conventional temperature responsive "block-and-bleed" valve 24, which in turn is connected to a control line CL extending to the surface and connectable to a control panel (not shown) through which the application of fluid pressure to the control line CL may be selectively effected. A vent pipe VP is provided in the temperature responsive "block-and-bleed" valve 24.

Valve 24 is a commercially available valve, for example, the valve listed as product number 885-30, illustrated on page 600 of the 1980 edition of the Baker CAC catalogue published by Baker CAC, Inc. of Belle Chasse, La. Upon the occurrence of a selected elevated temperature, valve 24 functions to block further fluid passage between the control line CL and pipe 22 and concurrently bleeds any fluid pressure existing in the chamber 16 to the vent pipe VP. Since this is a standard commercial item, further description thereof is believed unnecessary.

The outlet opening 18 is vertically disposed and communicates with a radial passage 26 in housing bottom wall 20, within which a tubular ball valve housing 30 is suitably sealingly secured as by threads 32. Ball valve housing 30 defines a central axial flow passage 31 terminating in an annular ball valve seat 34 with which a ball valve 36 cooperates, being urged into sealing engagement therewith by a compressed spring 39. Ball valve 36 is normally held off the seat 34 by a link 38 formed of fusible or eutectic material and supported in the fluid passage 31 through engagement of a looped end **38*a* against an internal shoulder 31*a* provided in passage 31**.

The outer end of ball valve housing 30 threadably receives the end of a safety valve control line SVL which extends to a downhole safety valve (not shown). Thus, so long as the temperature in the vicinity of the ball valve housing 30 or the fluid in passage 31 remains below the melting point of the fusible link 38, uninterrupted fluid passage is provided from the safety valve control line SVL through the outlet opening 18 and into the pressure chamber 16.

A piston 40 is provided which is reciprocally mounted in fluid pressure chamber 16 in a position intermediate inlet opening 14 and outlet opening 18. Piston 40 is provided on its periphery with appropriate seal 42 for slidably and sealably engaging the interior walls of the pressure chamber 16. Thus, the piston defines an upper pressure chamber A above it and a lower pressure chamber B below it. The piston 40 is further supported for reciprocal movements by a piston shaft 44 which is secured as by threads 45 to a central threaded hole 41 provided in piston 40. Shaft 44 is slidably and sealably mounted within a bearing sleeve 50 which is suitably secured as by threads 51 in a tubular extension 21 provided on the bottom wall 20 of the main housing 10. A cap 52 is threadably secured to the bottom end and of the bearing housing 50 and centrally apertured to permit an indicating stem 60 to project therethrough. Stem 60 is integrally connected to an enlarged diameter portion 62 which terminates in a upper outward flange portion 64. Flange portion 64 is urged upwardly by a spring 66 so that when the piston is in any elevated position above that shown in FIG. 1, the indicating stem 60 will be moved upwardly by spring 66 to provide a visual indication that the piston 40 has been shifted from its open flow position illustrated in FIG. 1.

A sealing plug 70 is secured to the top surface of piston 40 by a threaded stem 71 which cooperates with the threaded central bore 41 of piston 40. Plug 70 is provided with a conical sealing surface 72 which cooperates with a seal 74 which is mounted in a correspondingly shaped conical counter bore **14*a* defined in the lower end of the inlet opening 14. Thus, when the piston is elevated to its upper most position, as shown in FIG. 2, fluid flow through the pressure chamber 16 is completely terminated by the cooperation of the conical piston plug surface 72 with the O-ring 74**.

Additionally, a fluid passage 46 is provided which extends axially through the body of the piston 40. Passage 46 is provided with an enlarged upper counter bored portion **46*a*. Within the counter bore 46*a*, a metering valve 80 is provided, comprising an annular valve seat element 82 which is threaded into the upper portions of the counter bore 46*a* and a spring pressed ball valve 84 which is urged by a spring 86 into engagement with the seat 83 provided on the lower end of the annular seat element 82. Such seat 83 is provided with one or more notches 85 which permit a predetermined flow of fluid through the metering valve 80 even when the ball 84 is fully seated in engagement with the valve seat 83, as illustrated in FIG. 2**.

From the foregoing description, the operation of the described device will be readily be apparent to those skilled in the art. It will be noted that the housing 10 of the blow out preventer 1 defines a chamber 16 which is interposed in the control line leading from the surface located control valve to the downhole safety valve. Referring now to FIG. 1, the elements of the blow out preventer are shown in the positions occupied subsequent to the application of a control fluid pressure through line CL to the subsurface control valve through line SVL. Such fluid pressure passes freely through the pressure chamber 16 by forcing the ball valve 84 of the metering valve 80 off its seat and then flowing into the outlet 18 and thence through the ball valve housing 30 to the control line SVL leading to the subsurface safety valve. Concurrently, however, the piston 40 is gradually moved downwardly due to the differential fluid pressure exerted on the upper and lower surfaces of the piston 40. The pressure in the upper chamber A acts on the entire diameter of the piston 40, while the pressure in the lower chamber B acts only on that portion of the piston diameter that is external to the piston shaft 44. Thus, the piston is gradually moved downwardly to the position shown in FIG. 1 and, so long as fluid pressure is continued to be supplied to the subsurface safety valve from the control panel, the piston 40 will maintain its position illustrated in FIG. 1.

Figure 2:
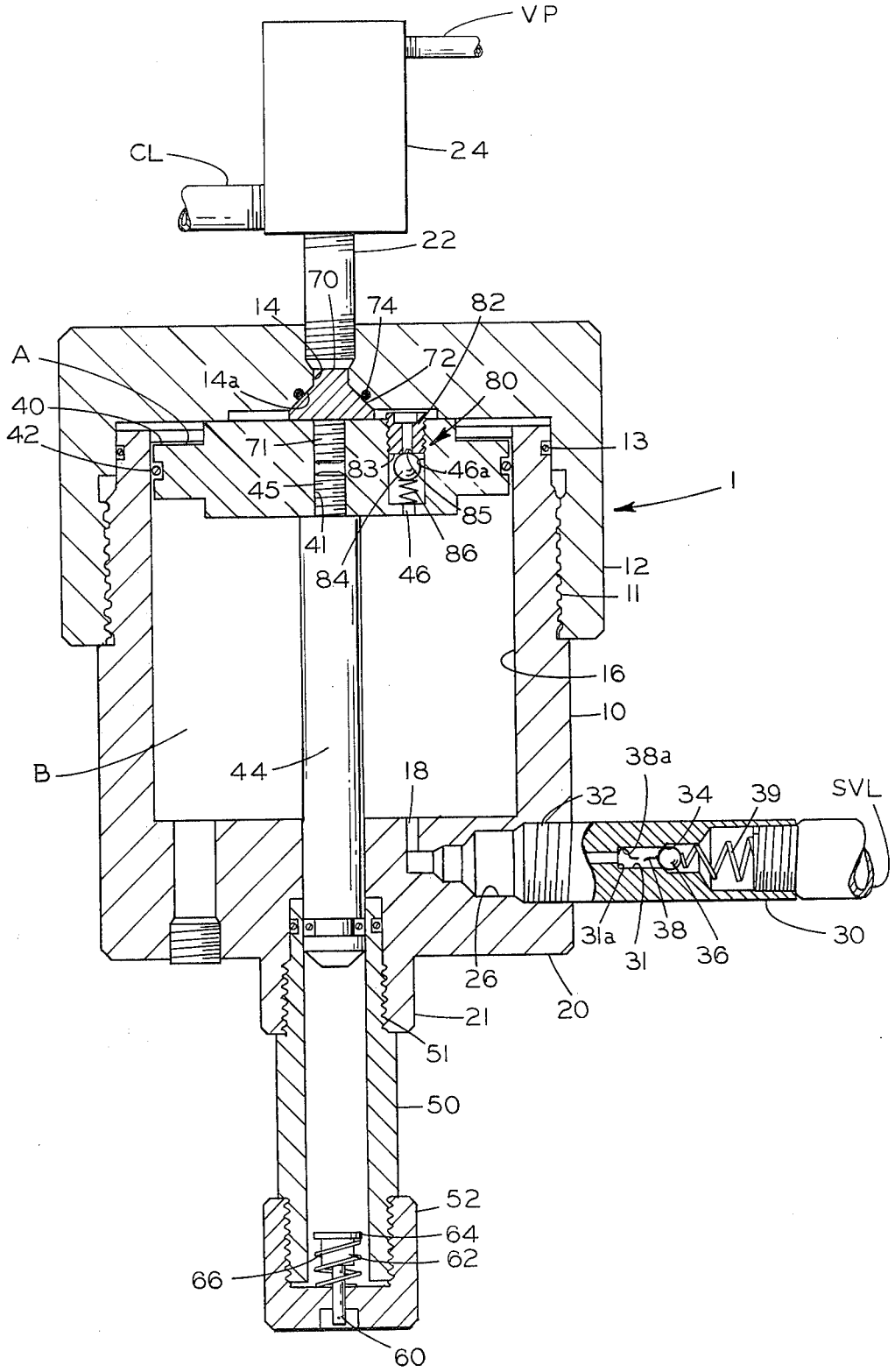
FIG. 2 is a view similar to FIG. 1 but showing the elements of the valve in its closed or flow blocking position.

Referring now to FIG. 2, in the event that the control panel is actuated to remove fluid pressure from the control line conduit CL and hence from the pressure chamber A above the piston 40, the fluid pressure trapped in the control line SVL leading to the safety valve will operate on the piston 40 to force it upwardly due to the fact that the ball 84 of the metering valve 80 permits only a limited reverse fluid flow through the bypass conduit 46. This will cause the conical surface 72 on the piston valve plug 70 to engage the seal 74 surrounding the inlet opening 14 and effect the cutoff of fluid flow from pressure chamber 16 to the control panel. Thus, any trapped gas in control line SVL is allowed to freely expand into the chamber 16. This allows the pressure acting on the down hole safety valve to decrease below the pressure required to close the valve.

In the event of an emergency condition resulting in a reverse flow of pressure fluid upwardly through conduit SVL into the blow out preventer 1, the operation of the piston 40 will be the same as heretofore described and the blow out preventer will effectively seal off the conduit CL leading to the control panel.

As a further precaution, in the event of an adjacent fire, fluid communication upwardly through the control line SVL will be prevented by the melting of the feasible link 38 which maintains the ball valve 36 in a position off its seat. Exposure of eutectic link 38 to a selected high temperature causes it to melt or droop and permits the ball valve 36 to move into sealing engagement with its seat 34, thus interrupting any further fluid transmission from the subsurface control line SVL. Foremostly, the temperature responsive "block-and-bleed" valve 24 may be selected to function in response to a lower temperature to effect the blockage of fluid passage between pipe 22 and the control conduit CL and, at the same time, bleed the pressure existing in the blow out preventer chamber 16 through the vent pipe VP to allow the safety valve to close.

It is therefore apparent that the heretofore described blow out preventer is completely effective under emergency conditions to achieve the cutoff of fluid flow upwardly through the control conduit extending to the downhole safety valve. Even though trapped gas may exist in the downhole control line SVL, this gas is now ineffective to prevent the closing of the blow out preventer, since the gas effects the rapid movement of the piston 40 to its upper position wherein the inlet opening 14 is sealed through the cooperation of valve plug 70 with the seal 74.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A blow out preventer for use in a control conduit for a downhole safety valve, said safety valve being manipulatable between open and closed positions upon variation of pressure within the control conduit; said blow out preventer comprising: a housing defining a cylindrical fluid chamber adapted for interposition in the control conduit and having an axially spaced fluid inlet and a fluid outlet; a piston reciprocable inside said chamber between a first position adjacent said fluid inlet and a second position adjacent said fluid outlet; said piston having two opposed faces; first valve means on one said face of said piston for closing said fluid inlet only when said piston is in said first position; a fluid passage extending axially from said one face to the other through said piston; second valve means for metering fluid flow through said fluid passage in the direction toward said one piston face; a spring pressed ball check valve disposed in said fluid outlet and constructed to block fluid flow in the conduit from the safety valve in its closed position; and a fusible link normally holding said ball check valve in an open position, whereby the melting of said fusible link upon the occurrence of abnormal temperature permits said ball check valve to close said conduit and prevent fluid flow from the safety valve upwardly through the conduit.

2. The blow out preventer of claim 1 further comprising a temperature responsive valve connected between said fluid inlet and the control conduit, said temperature responsive valve being operable by a predetermined increase in temperature to block fluid flow from said conduit to said fluid inlet to bleed said pressure from the blow out preventer.

3. The blow out preventer of claim 1 wherein a radially disposed housing extension defines said fluid outlet, and said ball valve and fusible link are disposed in the outer portions of said radially disposed housing.

* * * * *